US005966004A

United States Patent [19]

Kadanka

[11] Patent Number: 5,966,004

[45] Date of Patent: Oct. 12, 1999

[54] ELECTRONIC SYSTEM WITH REGULATOR, AND METHOD

[75] Inventor: Petr Kadanka, Roznov pod Radhostem, Czech Rep.

[73] Assignee: Motorola, Inc., Schaumburg, Ill.

[21] Appl. No.: 09/024,434

[22] Filed: Feb. 17, 1998

[51] Int. Cl.[6] ..... G05F 1/563; G05F 1/618

[52] U.S. Cl. ..... 323/271; 323/224

[58] Field of Search ..... 323/224, 225, 323/226, 284, 271, 273

[56] References Cited

U.S. PATENT DOCUMENTS

| | | | |
|---|---|---|---|
| 4,319,179 | 3/1982 | Jett, Jr. | 323/282 |
| 4,618,812 | 10/1986 | Kawakami | 323/224 |
| 4,906,913 | 3/1990 | Stanojevic | 323/273 |
| 4,928,056 | 5/1990 | Pease | 323/314 |
| 4,964,029 | 10/1990 | Severinsky et al. | 323/224 |
| 5,302,889 | 4/1994 | Marsh | 323/284 |
| 5,422,559 | 6/1995 | Hall et al. | 320/21 |
| 5,471,174 | 11/1995 | Petty et al. | 330/257 |
| 5,521,488 | 5/1996 | Stockstad et al. | 323/223 |
| 5,608,312 | 3/1997 | Wallace | 323/224 |
| 5,731,694 | 3/1998 | Wilcox et al. | 323/287 |

*Primary Examiner*—Adolf Deneke Berhane
*Attorney, Agent, or Firm*—Robert D. Atkins; Rennie William Dover

[57] ABSTRACT

In an electronic system (100), a regulator (200) couples a supply device (110) to a consuming device (120) through a series switch (210) and provides output current $I_{OUT}$. A shunt switch (220) is provided across the output. Fast changes of $I_{OUT}$ due to switching on and off the consuming device (120) are accommodated by the regulator (200). The regulator (200) has a voltage divider (250, 260) to measure $V_{OUT}$. Operational amplifiers (230 and 240') control transistors (210, 220) with different switching thresholds, They compare a measurement voltage $V_M$ derived from $V_{OUT}$ to a reference voltage $V_{REF}$. When the consuming device (120) is switched off, the first amplifier (230) makes the series transistor (210) non-conductive; and then the second amplifier (240') makes the shunt transistor (220) conductive for a short time. Capacitance at the output node (205) is substantially discharged. After overshooting, the voltage $V_{OUT}$ returns to its previous value. Unwanted undershooting of $V_{OUT}$ is substantially avoided.

9 Claims, 4 Drawing Sheets

100

100

-PRIOR ART-

-PRIOR ART-

500

ELECTRONIC SYSTEM WITH REGULATOR, AND METHOD

FIELD OF THE INVENTION

The present invention generally relates to electronic circuits, and more particularly, to an electronic system with regulator and to a method therefore.

BACKGROUND OF THE INVENTION

Many electronic system (e.g., mobile phones) comprise regulators which couple supply devices (e.g., batteries, main transformers) and consuming devices (e.g., transmitters, speakers, logic circuits, memories). The properties of the regulators are described, for example, by an input voltage $V_{IN}$, an input current $I_{IN}$, an output voltage $V_{OUT}$, and an output current $I_{OUT}$. According to a time scheme the regulator provides $V_{OUT}$ and $I_{OUT}$ within predetermined minimum and maximum values to the consuming device. A reverse action from the consuming device to the regulator is often not wanted but should be accommodated by the regulator. A regulator which uses energy effectively supplies $V_{OUT}$ and $I_{OUT}$ according to the needs the consuming components.

In a nonlimiting example of a mobile phone, the regulator receives $V_{IN}$ and $I_{IN}$ from a battery and provides $V_{OUT}$ and $I_{OUT}$ to a transmitter and to a memory. The transmitter sends radio signals in bursts (e.g., "operating mode A"). During a waiting time between the bursts (e.g., "operating mode B"), the regulator should recover from changes of $V_{OUT}$ caused by the transmitter. The waiting time is crucial for the performance of the mobile phone. While waiting, the regulator should consume only a low quiescent current (e.g., $I_{IN}$); and the output voltage $V_{OUT}$ should stay above a minimum value required by the memory. Regulators for such applications are known in the art as low-drop-out (LDO) regulators.

The present invention seeks to provide regulators which mitigate or avoid disadvantages and limitations of the prior art.

DETAILED DESCRIPTION OF THE PREFERRED EMBODIMENT

Figure 1:
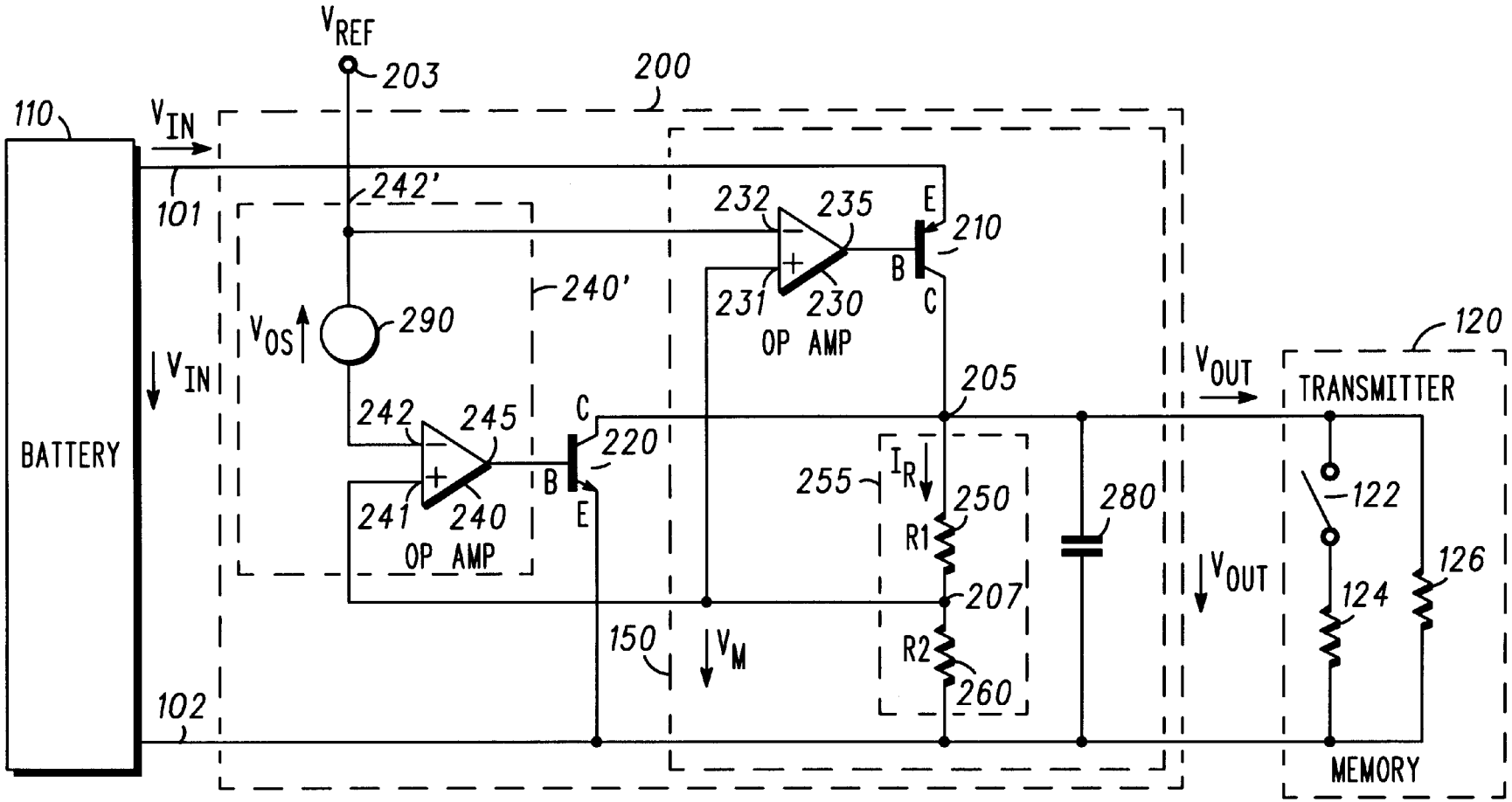
FIG. 1 illustrates a simplified circuit diagram of an electronic system according to the present invention.

FIG. 1 illustrates a simplified circuit diagram of electronic system 100 according to the present invention. Electronic system 100 comprises supply device 110, regulator 200 (dashed frame) and optional consuming device 120. For example, and not intended to be limiting, supply device 110 can be a battery; and consuming device 120 can be the combination of a transmitter and a memory. Supply device 110 provides input voltage $V_{IN}$ to regulator 200 at reference lines 101 and 102. Input current $I_{IN}$ goes from supply device 110 to regulator 200 (illustrated on line 101). Regulator 200 provides output voltage $V_{OUT}$ between output node 205 and reference line 102 to consuming device 120. Consuming device 120 exhibits an inherent load between output node 205 and line 102. This load can be an ohmic resistance, a capacitance, an inductance or a combination therefrom. For convenience of explanation, the load between node 205 and line 102 is represented by (a) serially coupled resistor 124 and switch 122 (e.g., the "transmitter") and (b) resistor 126 (e.g., the "memory"). In the symbolic representation of FIG. 1, closed switch 122 means, for example, that the transmitter is operating and that consuming device 120 behaves like a current sink. When switch 122 opens, the current demand of the transmitter quickly decreases. The phrases "switch 122 closes" and "switch 122 opens" are intended to represent that the portion illustrated by resistor 124 (e.g., the "transmitter") of consuming device 120 starts to operate and stops to operate, respectively.

The current change (e.g., when switch 122 opens and closes) is accompanied by an inherent change of output voltage $V_{OUT}$. At all time, however, consuming device 120 requires a predetermined minimum voltage $V_{OUTMIN}$ (e.g., so that the memory continues to store data.). According to the present invention, regulator 200 accommodates the load changes in an efficient way: Depending on the output voltage $V_{OUT}$, regulator 200 switches node 205 to line 101 or to line 102. Details are explained later in the explanation of regulator 200 and of its preferred method of operation.

Regulator 200 comprises voltage sensor 255 with resistors 250 and 260 for measuring $V_{OUT}$, optional capacitor 280, comparators 230 and 240, switches 210 and 220, and voltage source 290. Preferably, regulator 200 receives reference voltage $V_{REF}$ on optional terminal 203. This is convenient, but not essential for the present invention. Persons of skill in the art know how to provide $V_{REF}$. For example, $V_{REF}$ can be provided internally and can be derived from voltage $V_{IN}$.

Comparators 230 and 240 are, preferably, implemented by operational amplifiers ("op amps") wherein the terms "comparators" and "operational amplifiers" are used here as synonyms. Op amps 230 and 240 have non-inverting inputs 231 and 241, respectively, which are illustrated by the "+" symbol. Also, op amps 230 and 240 have inverting inputs 232 and 242, respectively, with the "−" symbol. This input assignments are convenient for explaining the present invention but not limited thereto. Persons of skill in the art are able, based on the description herein, to modify op amps 230 and 240 and to implement regulator 200 in a different way without departing from the present invention.

Switches 210 and 220 are, preferably, implemented by bipolar transistors (i.e., transistors 210 and 220). The term "transistor" is intended to include any component having at least two main electrodes and a control electrode. The impedance between the main electrodes (e.g., emitter E and collector C) is controlled by a signal applied to the control electrode (e.g., base B). For convenience, in FIG. 1 the letters "E", "C" and "B" indicate the transistor electrodes. Preferably, transistor 210 is a pnp-transistor (e.g., "first type") and transistor 220 is a npn-transistor (e.g., "second type"). "First type" and "second type" are intended to distinguish complementary transistors of opposite conductivity and can refer to either pnp-types or npn-types, as the case may be. To have complementary transistors 210 and 220 is convenient, but not essential for the present invention. For example, transistors of equal type can also be used. Those of skill in the art are able, based on the description herein, to use transistors in different configurations without departing from the scope of the present invention. Although the present invention is explained in connection with bipolar transistors, other transistor types (e.g., field effect transistors) are also useful.

As used herein, a "conductive" transistor is able to carry a current between its main electrodes; whereas a "non-conductive" transistor is substantially not able to carry a current.

Preferably, transistor 210 has larger physical dimensions (e.g., emitter areas) than transistor 220. In other words, transistor 210 can carry higher currents (i.e. $I_{IN}$) than transistor 220.

For convenience of further explanation, op amp 240' (dashed frame) comprises op amp 240 and voltage source 290. Op amp 240' has inputs 241 and 242' (at terminal 203) parallel coupled to inputs 231 and 232 of op amp 230, respectively. Op amps 230 and 240' receive substantially the same input voltages (e.g., $V_{REF}$ and $V_M$, explained later) and have different switching thresholds. In other words, there is an input offset voltage $V_{OS}$ between op amps 230 and 240.

Voltage source 290 as shown in FIG. 1 is intended to illustrate any device which temporarily or substantially at all time can cause an offset voltage between its terminals. Such a device can be a resistor, a transistor, a diode, or a similar device. Persons of skill in the art are also able, based on the description herein, to provide a voltage drop by other means, such as by dimensioning the components of op amps 230 and 240, without departing from the scope of the present invention. For example, a voltage offset between input stages of transistor amplifiers can be provided by different emitter areas. To associate voltage source 290 with op amp 240 is intended as a convenient example for explanation. A voltage source could also be associated with op amp 230.

In the example of FIG. 1, the components of regulator 200 are coupled as follows. The emitter (E) of transistor 210 is coupled to reference line 101. The collector (C) of transistor 210 is coupled to output node 205. Capacitor 280 is coupled between output node 205 and reference line 102. In voltage sensor 255, resistors 250 and 260 are serially coupled between output node 205 and reference line 102 via node 207. Resistor 250 has a value $R_1$ and resistor 260 has a value $R_2$. The collector (C) of transistor 220 is coupled to output node 205; and the emitter (E) of transistor 220 is coupled to reference line 102. The base (B) of transistor 210 is coupled to output 235 of op amp 230. The base (B) of transistor 220 is coupled to output 245 of op amp 240. Input 231 of op amp 230 and input 241 of op amp 240 are coupled together to node 207. Input 232 of op amp 230 is coupled to terminal 203. Input 242 is coupled to terminal 203 via voltage source 290.

The measurement voltage $V_M$ is the voltage across resistor 260, the voltage $V_{OS}$ is the voltage of voltage source 290, and the current $I_R$ is the current through resistors 250 and 260. Regulator portion 150 is illustrated by dashed line 150 around voltage sensor 255, transistor 210, and op amp 230.

Figure 2A:
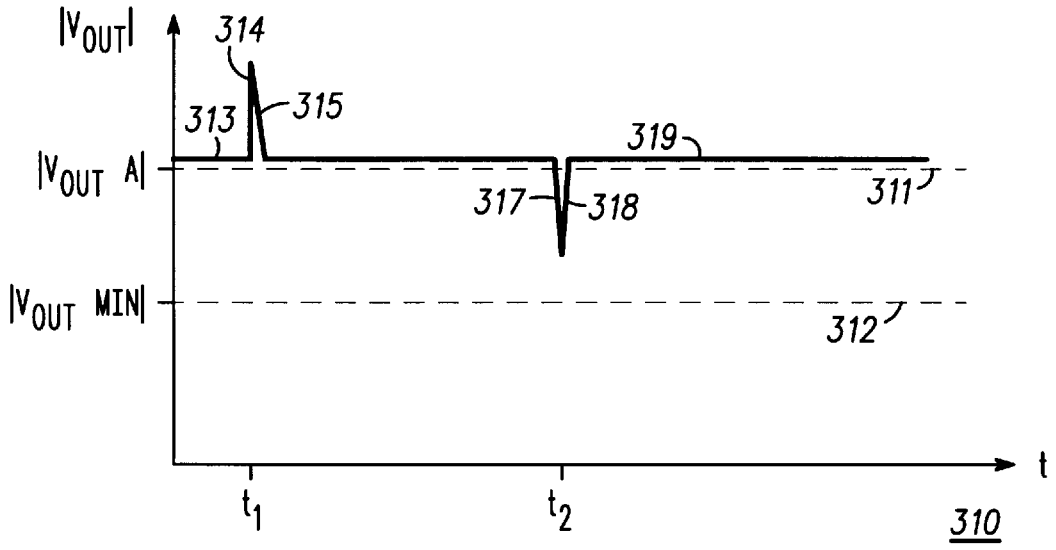
FIGS. 2A and 2B illustrates the operation of a regulator of the system of FIG. 1 according to a method of the present invention by simplified time diagrams.
Figure 2B:
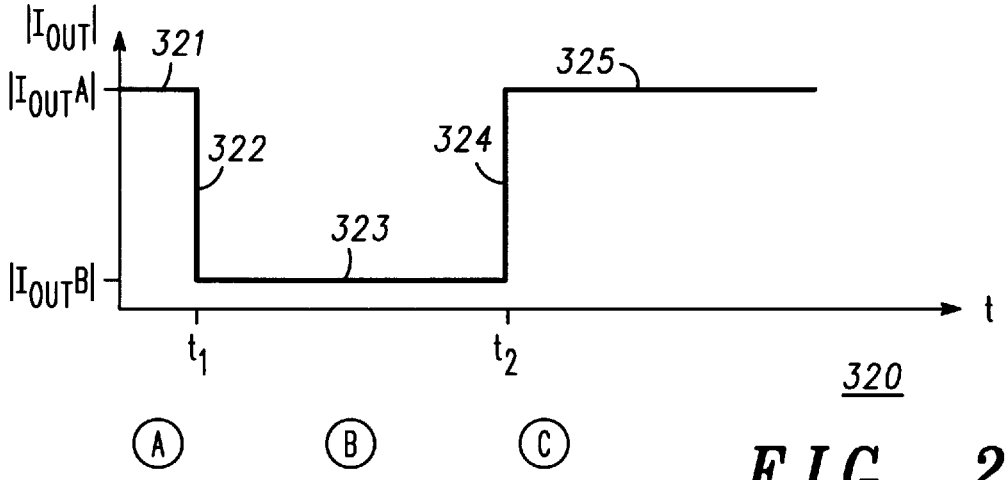

FIGS. 2A and 2B illustrates the operation of regulator 200 of system 100 according to a method of the present invention by simplified time diagrams 310 and 320. Output voltage $|V_{OUT}|$ (diagram 310) and output current $|I_{OUT}|$ (diagram 320) on vertical axes are related to time t on horizontal axes (diagrams 310 and 320). For simplicity of explanation, voltages and currents are considered in the following with their absolute values (symbols ||). The terms "increase", "decrease" and "change" in all possible language variations, are intended to represent modifications of the absolute values. This convention includes that the actual voltages and the actual currents in a regulator implemented according to the present invention can have positive and/or negative signs.

Regulator 200 alternatively operates in a first operating mode ("A-mode") when consuming device 120 of system 100 is active (e.g., transmitting radio signals in a burst) and in a second operating mode ("B-mode") when consuming device 120 is not active (e.g., waiting time between bursts, but supporting the memory).

Transition time point $t_1$ marks the transition between the first mode and the second mode; and transition time point $t_2$ marks the transition between the second mode and the first mode. For simplicity, points $t_1$ and $t_2$ are intended to comprise the time intervals in which mode transitions are completed.

In diagram 310, dashed line 311 (parallel to the t-axis) indicates a minimum output voltage $|V_{OUT\ A}|$ for the first operating mode; and dashed line 312 (parallel to the t-axis) indicates a minimum output voltage $|V_{OUT\ MIN}|$ for the first and second operating modes. Preferably, the voltages are related as:

$$|V_{OUT\ A}|>|V_{OUT\ MIN}|>0 \tag{1}$$

On the vertical axis of diagram 320, $|I_{OUT\ A}|$ symbolizes the current $|I_{OUT}|$ for the first operating mode and $|I_{OUTB}|$ symbolizes the current $|I_{OUT}|$ for the second operating mode. Preferably, $|I_{OUT\ B}|$ has a value of about zero($|I_{OUT\ B}|\approx 0$), wherein a current consumed by resistor 126 (e.g., the "memory") is neglected for simplicity of explanation.

Before $t_1$ (A-mode), it is assumed that switch 122 is closed. Input current $|I_{IN}|$ flows through the emitter-collector path of conductive transistor 210. Node 205 splits $|I_{IN}|$ into $|I_{OUT}|$ and current $|I_R|$ through resistors 250 and 260, that is:

$$|I_{IN}|\approx|I_{OUT}|+|I_R| \tag{2}$$

Conveniently, current $|I_R|$ is substantially smaller (<<) than current $|I_{OUT}|$ (preferably, higher $R_1$ and $R_2$ values compared to the values of e.g., resistor 124). Resistors 250 and 260 of voltage sensor 255 provide the measurement voltage $|V_M|$ between node 207 and reference line 102, expressed as:

$$|V_M| = |V_{OUT}| * \frac{R_2}{R_1 + R_2} \tag{3}$$

with the * symbol for multiplication and the fraction line for division. Op amp 230 compares $|V_{REF}|$ and $|V_M|$ at input 231 and 232, respectively, such that conductive transistor 210 provides $|V_{OUT}|$ (trace 313) with an absolute value equal to (=) or larger than (>)$|V_{OUT\ A}|$,that is:

$$|V_{OUT}|\geqq|V_{OUT\ A}| \tag{4}$$

Output current $|I_{OUT}|$ has a value of substantially $|I_{OUT\ A}|$ (trace 321). Op amp 240 receives a voltage $|V_{REF}|+|V_{OS}|$ at input 242 and $|V_M|$ at input 241. Op amp 240 controls transistor 220 to be substantially non-conductive.

At or during $t_1$, switch 122 opens and voltages $|V_{OUT}|$ and $|V_M|$ change. Preferably, these voltages increase. The voltages $|V_{REF}|$ at input 232 of op amp 230 and $|V_{REF}+V_{OS}|$ at input 242 of op amp 240 remain substantially unchanged. Op amp 230 and 240 (having different thresholds) respond to the changing voltage $|V_M|$ at different moments: First, op amp 230 makes transistor 210 substantially non-conductive (control signal from output 235 to the base B); and second, op amp 240 makes transistor 220 substantially conductive (control signal from output 245). Thereby, transistors 210 and 220 substantially do not conduct at the same time. A contention between transistors 210 and 220 is avoided. When neglecting a current through resistor 126, transistor 220 does substantially not need to carry current $|I_{IN}|$ (cf., the mentioned physical dimensions). Output voltage $|V_{OUT}|$ can temporarily go to high values $|V_{OUT}|$ $|V_{OUTA}|$ (trace 314, "overshooting"). The high values of $V_{OUT}$ are accommodated by consuming device 120. Transistor 210 substantially interrupts the flow of current $|I_{IN}|$ to output node 205 so that $|I_{OUT}|$ becomes $|I_{OUT}|$ (trace 322). Transistor 220 discharges (trace 315) capacitor 280. The measurement voltage $|V_M|$ is decreasing with the discharging so that op amp 240 makes transistor 220 non-conductive again.

In other words, a delay occurs between switching off transistor 210 and switching on transistor 220. This is provided by op amps 230 and 240' with different switching thresholds (see difference $|V_{OS}|$ between input 242 and 242') which receive similar input voltages (e.g., $|V_{REF}|$ and $V_M|$) at parallel coupled inputs (231/241 and 232/242'). The consecutive switching of transistors 210 and 220 is achieved without the need of further control logic or additional control signals. Instead, the control of op amps 230 and 240' can be considered as a feedback from output node 205. The feedback is stable and does not lead to oscillations.

Preferably, the sink branch formed by transistor 220 between output node 205 and line 102 is active only during the load transient of time $t_1$. At other times, this branch is not active, i.e. transistor 220 is substantially not conductive.

Between $t_1$ and $t_2$ (B-mode), transistor 220 remains substantially non-conductive so that there is no significant quiescent current through transistors 220. Transistor 210 conducts only the small current of resistor 126 (e.g., the memory) and the small current through resistors 250 and 260. This is an important advantage of the present invention and, for example, saves battery power. $|I_{OUT}|$ is at $|I_{OUT\,B}|\approx 0$ (trace 323).

At or during $t_2$, switch 122 closes. Op amp 230 receiving $|V_{REF}|$ makes transistor 210 conductive and $|I_{OUT}|$ increases from $|I_{OUT\,B}|$ to $|I_{OUT\,A}|$ (trace 324). With the fast increase of $|I_{OUT}|$, the output voltage $|V_{OUT}|$ can temporarily drop ("undershooting", traces 317 and 318). During the drop, $|V_{OUT}|$ does not substantially go below $|V_{OUTMIN}|$.

After $t_2$ (A-mode), regulator 200 operates similar as in the time before $t_1$ (traces 319 and 324).

Figure 3A:
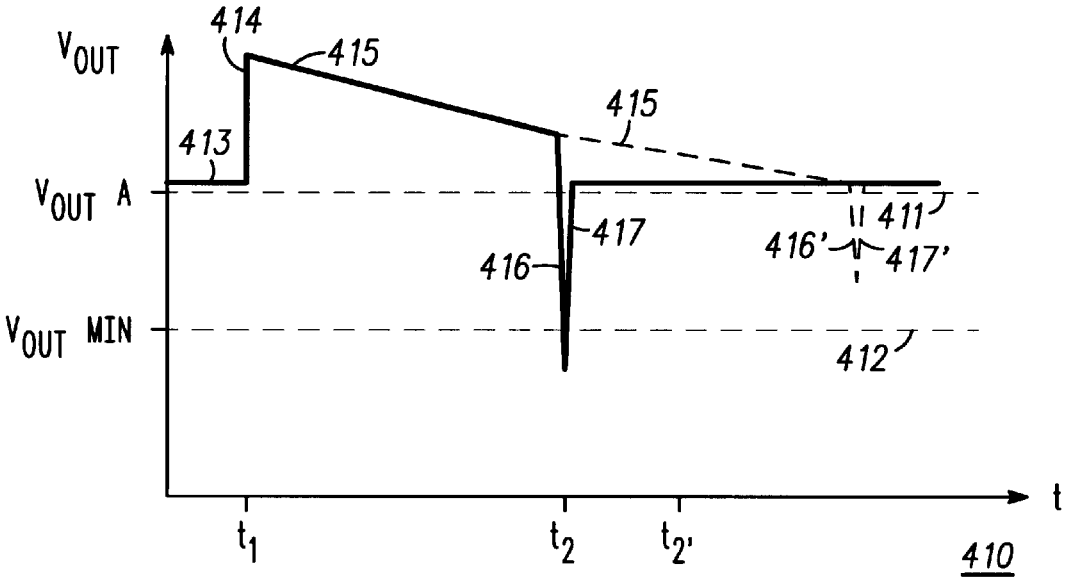
FIGS. 3A and 3B illustrates the operation of a prior art regulator portion by simplified time diagrams.
Figure 3B:
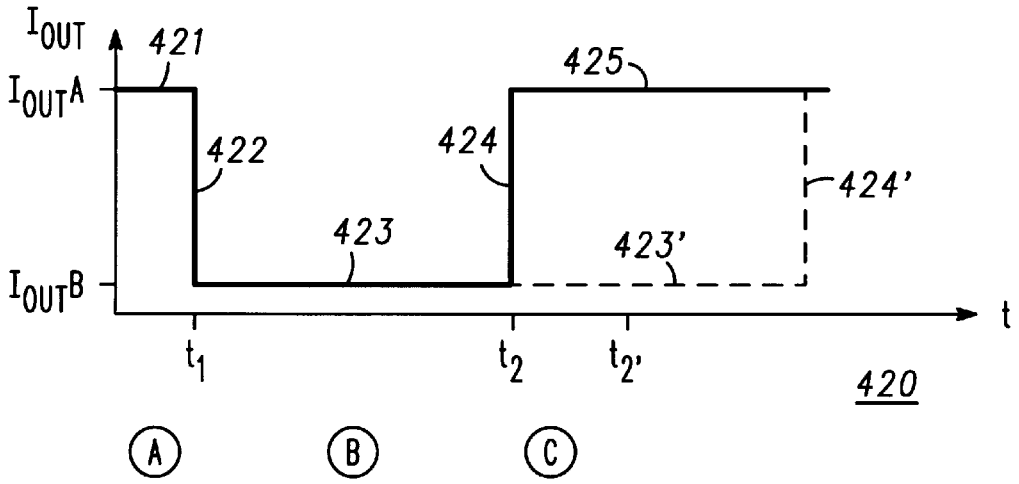

FIGS. 3A and 3B illustrates the operation of regulator portion 150 alone, by simplified time diagrams 410 (FIG. 3A) and 420 (FIG. 3B). Similar to FIG. 2, output voltage $V_{OUT}$ (diagram 410) and output current $I_{OUT}$ (diagram 420) on vertical axes are related to time t on horizontal axes (diagrams 410 and 420). Regulator portion 150 alone is used in the prior art. Regulator 150 operates in the first mode (A-mode) before $t_1$ and after $t_2$ and operates in the second mode (B-mode) between $t_1$ and $t_2$. In diagram 410, dashed line 411 indicates $V_{OUTA}$ and dashed line indicates $V_{OUTMIN}$.

(i) Plain traces 413–418 for $V_{OUT}$ in diagram 410 and plain traces 421–425 for $I_{OUT}$ in diagram 420 are explained first.

Before $t_1$ (A-mode), switch 122 is closed. Transistor 210 is conductive and regulator portion 150 provides $|V_{OUT}|>\approx|V_{OUT\,A}|$ (trace 413) and $|I_{OUT}|\approx|I_{OUT\,A}|$. At time $t_1$, switch 122 opens and transistor 210 is switched off (becomes substantially non-conductive). The output current $I_{OUT}$ is decreasing (trace 422) and the output voltage $|V_{OUT}|$ quickly goes to a higher value above $|V_{OUT\,A}|$ (trace 414). In the following (B-mode between $t_1$ and $t_2$), capacitor 280 is discharged (trace 415) by resistors 250 and 260. This takes more time than discharging by transistors 220 in regulator 200 of the present invention, hence trace 415 has a slow decay. At time $t_2$, voltage $V_{OUT}$ temporarily drops below $V_{OUTMIN}$ (traces 416 and 417). This is not wanted. After $t_2$ (again A-mode), regulator portion 150 operates as before $t_1$. In FIGS. 2 and 3, the time interval between $t_1$ and $t_2$ is assumed to be substantially the same.

(ii) Now, dashed traces 416' and 417' (at time $t_2'$) for dropping voltage $V_{OUT}$ in diagram 410 and trace 424' (also at time $t_2'$) for increasing current $I_{OUT}$ in diagram 420 are considered. Plain traces 416 and 417 in diagram 410 (drop) and plain trace 424 in diagram 420 are not considered. Trace 415 should be extended by dashed trace 415' and trace 423 should be extended by dashed trace 423'. The voltage shift by which $V_{OUT}$ temporarily drops during $t_2$ (see above (i) ) and $t_2'$, depends on the magnitude of $V_{OUT}$ in the present discharging state. At time $t_2'$ which is later than time $t_2$, the load capacitance has been more discharged, that is:

$$|V_{OUT}(t_2')|<|V_{OUT}(t_2)| \tag{5}$$

Hence, at $t_2'$ the voltage $V_{OUT}$ drops to a value above $V_{OUTMIN}$ which is acceptable. However, waiting until $t_2'$ is a further disadvantage of the prior art. In other words, regulator 200 of the present invention discharges capacitor 280 faster than regulator portion 150 alone (prior art). Therefore, in regulator 200 of the invention, $|V_{OUT}|$ reaches $|V_{OUT\,A}|$ earlier.

In the prior art, resistors 250 and 260 are used for a double purpose: (a) measuring $V_{OUT}$ and (b) discharging the load capacitance. For (a) measuring, the resistance values $R_1$ and $R_2$ should be, preferably, high (i.e. to keep quiescent current low) and for (b) discharging, $R_1$ and $R_2$ should be, preferably, low. The optimization of the resistor values determines (a) the power consumption of regulator portion 150 and (b) the discharge time or waiting time between $t_1$ and $t_2$ (or $t_1$ and $t_2'$).

In system 100 of the present invention, this problems are solved by having different components for measuring (e.g., resistors 250 and 260) and components for discharging (e.g., transistors 220 and op amp 240). Waiting times are substantially reduced. This feature makes regulator 200 applicable for electronic systems in which consuming device 120 operates at high burst rates. The reduction of waiting times can also reduce software expenses.

Figure 4:
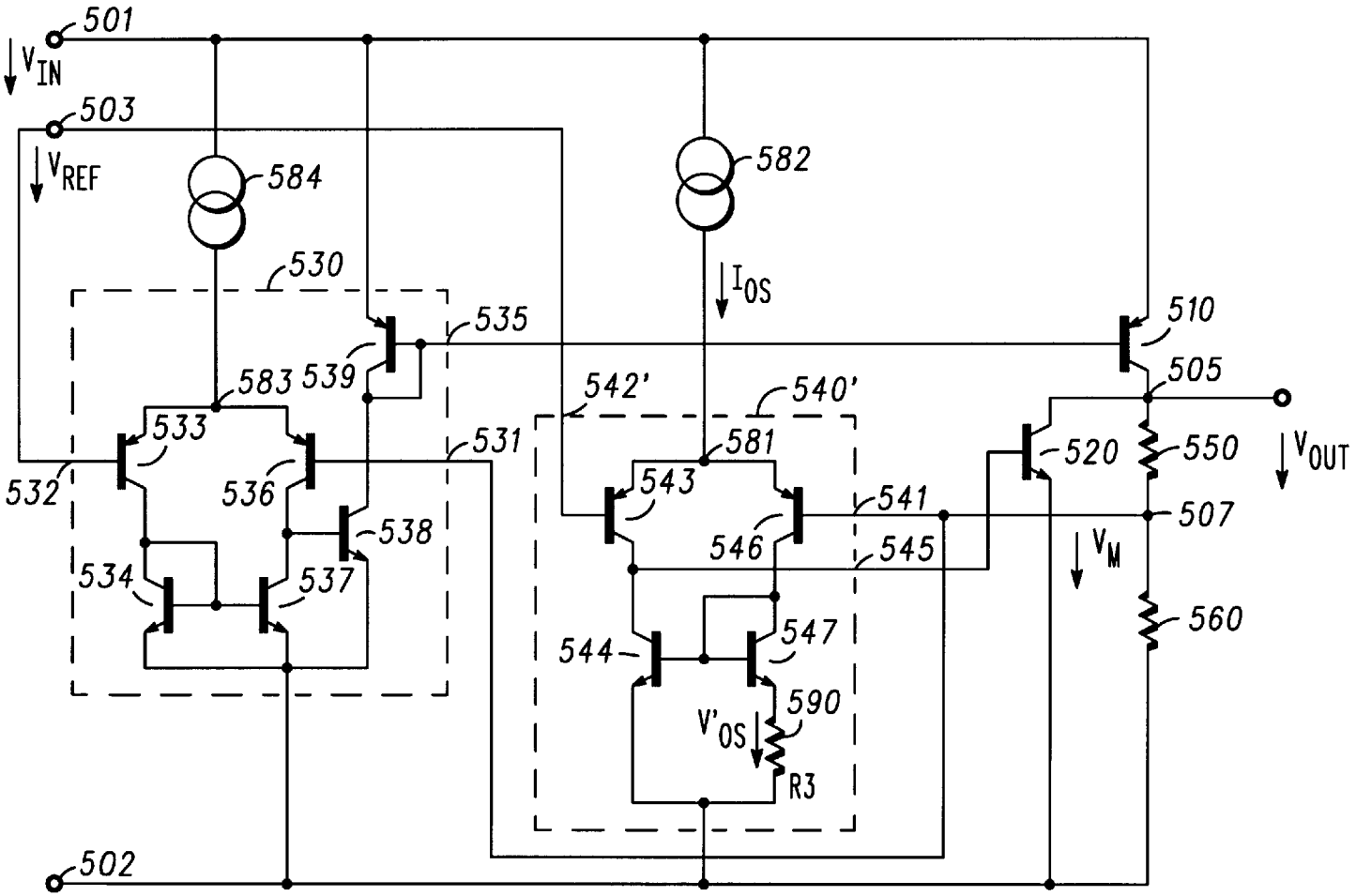
FIG. 4 illustrates a simplified circuit diagram of the regulator according to a preferred embodiment of the present invention.

FIG. 4 illustrates a simplified circuit diagram of regulator 500 according to a preferred embodiment of the present invention. In FIG. 1 and FIG. 4, the following reference numbers correspond to analogous components or combinations thereof: 200/500, 101/501, 102/502, 203/503, 102/502, 203/503, 205/505, 207/507, 210/510, 230/530, 231/531, 232/532, 235/535, 240'/540', 241/541, 242'/542', 245/545, 250/550 and 260/560. However, their function can be different as a consequence of the embodiment of regulator 500.

Regulator 500 comprises resistors 550, 560 and 590, current sources 582 and 584, pnp-transistors 510, 533, 536, 539, 543 and 546 and npn-transistors 520, 534, 537, 538, 544 and 547. Regulator 500 receives input voltage $V_{IN}$ between reference line 501 (the emitter of transistor 510) and reference line 502. Regulator 500 provides output voltage $V_{OUT}$ between output node 505 (the collector of transistor 510) and reference line 502. Regulator 500 also receives reference voltage $V_{REF}$ at terminal 503.

The transistor electrodes ("emitter", "collector" and "base") are written here with the article "the". In FIG. 4, the transistors are illustrated as discrete components. These conventions are convenient for explanation and intended to include that (a) a single transistors can have multiple electrodes with similar function (i.e., multiple emitters, multiple collectors, and multiple bases) and that (b) two or more transistors can share electrodes (e.g., a common emitter of two transistors). Conveniently, transistors 533 and 543 are integrated on a semiconductor substrate with common emitter regions and common base regions but with separate collector regions. Similarly, transistors 536 and 546 can have a common emitter and a common base. Those of skill in the art are able to combine transistors in a different ways without departing from the scope of the invention.

Transistors 533, 534, 536, 537, 538 and 539 form op amp 530 (dashed frame) with input 531 at the base of transistor 536, input 532 at the base of transistor 533 and output 535 at the collector and base of transistor 539. Transistors 543, 544, 546 and 547 form op amp 540' (dashed frame) with input 541 at the base of transistor 546, input 542' at the base of transistor 543 and output 545 at the collector of transistor 543. Measurement voltage $V_M$ is the voltage between node 507 and reference line 502 (across resistor 560).

Current source 582 is coupled between line 501 and node 581; and current source 584 is coupled between line 501 and node 583. Transistor 510 is coupled with the emitter to reference line 501 and with the collector to output node 505. Resistors 550 and 560 are serially coupled between output node 505 and reference line 502 via node 507. Transistor 520 is coupled with the collector to output node 505 and with the emitter to reference line 502.

In op amp 530, the emitters of transistors 533 and 536 are coupled together to node 583. The collectors of transistors 533 and 534 are coupled together; and the collectors of transistors 536 and 537 are coupled together. The emitters of transistors 534, 537 and 538 are coupled together and to reference line 502. The bases of transistors 534 and 537 are coupled together and to the collector of transistor 534 (current mirror configuration). The base of transistor 538 is coupled to the collector of transistor 537. The collector of transistor 538 is coupled to the collector of transistor 539. The emitter of transistor 539 is coupled to reference line 501. The base and the collector of transistor 539 are coupled to the base of transistor 510 (cf. output 535) so that transistors 539 and 510 form a current mirror.

In op amp 540', the emitters of transistors 543 and 546 are coupled together to node 581. The collectors of transistors 543 and 544 are coupled together; and the collectors of transistors 546 and 547 are coupled together. The emitter of transistor 544 is coupled to reference line 502. The emitter of transistor 547 is coupled to reference line 502 via resistor 590. The bases of transistors 544 and 547 are coupled together to the collector of transistor 547 (current mirror configuration). The collector of transistor 544 is coupled to the base of transistor 520 (output 545).

Resistor 590 with voltage drop $V_{OS}$ has the function of a voltage source (cf. source 290 with voltage $V_{OS}$) and determines a difference in the threshold voltages between op amp 530 and 540'. The value $R_3$ of resistor 590 depends on the current of current source 582. Persons of skill in the art able, to dimension $R_3$ and current $I_{OS}$ of current source 582, such that, op amp 540' has the desired offset voltage $V_{OS}$ in comparison to op amp 530.

In op amps 530 and 540', the bases of transistors 536 and 546, respectively, are coupled together to node 507 for receiving measurement voltage $V_M$ (inputs 531 and 541, respectively). Similarly, the bases of transistors 533 and 543 are coupled together to terminal 503 for receiving reference voltage $V_{REF}$ (inputs 541 and 542', respectively). Referring again to FIG. 1, the present invention can also be described as system which comprises the following: switch 210 ("regulating element") for temporarily pulling output node 205 to reference line 101 ("power line"); switch 220 for temporarily pulling output node 205 to reference line 102; first comparator 230 for controlling switch 210, first comparator 230 receiving a measurement voltage $V_M$ derived from output node 205 and reference voltage $V_{REF}$; second comparator 240' for controlling switch 220, second comparator 240' receiving the measurement voltage $V_M$ and the reference voltage $V_{REF}$, second comparator 240' having an input offset (e.g., voltage source 290) so that second comparator 240' activates (e.g., makes conductive) switch 220 to pull output node 205 to reference line 102 after comparator 230 has de-activated switch 210 to disconnect output node 205 from reference line 101.

Further, the present invention can also be described as an apparatus which comprises: switches 210 and 220 serially coupled between reference lines 101 and 102 via output node 205, switch 210 temporarily forwarding an input current $I_{IN}$ from reference line 101 to output node 205 and switch 220 temporarily discharging capacitance (e.g., capacitor 280) of output node 205 to reference line 102; consuming device 120 coupled between output node 205 and reference line 102 for temporarily sinking a load current $I_{OUT}$ (e.g., to line 102); voltage sensor 255 measuring voltage $V_{OUT}$ between output node 205 and reference line 102 and providing measurement voltage $V_M$; and comparators 230 and 240 for controlling switches 210 and 220, respectively, comparators 230 and 240 each receiving measurement voltage $V_M$, comparator 230 receiving reference voltage $V_{REF}$ and comparator 240 receiving reference voltage $V_{REF}$ with an offset (e.g., voltage $V_{OS}$). Changes of measurement voltage $V_M$ when consuming device 120 stops to sink the load current $I_{OUT}$ (cf. trace 422) making consecutively: (a) switch 210 substantially non-conductive and (b) switch 220 substantially conductive so that switch 210 releases output node 205 before switch 220 pulls output node 205 to reference line 102. Preferably, switch 220 pulls output node 205 to reference line 102 only after switch 210 has released node 205 from reference line 101.

Still further, wherein reference numbers are intended only to be a convenient example for the purpose of explanation, the present invention can be described as an apparatus which comprises: op amp 230 having inputs 231 and 232 and output 235; op amp 240' having inputs 241 and 242' and output 245, op amps having different switching thresholds (cf. offset $V_{OS}$); input terminal 203 coupled input 232 of op amp 230 and to input 242' of op amp 240'; transistors 210 and 220, each of the transistors having first and second main electrodes (e.g., collectors and emitters, respectively) and a control electrode (e.g., a base), first main electrodes (e.g., the collectors of transistors 210 and 220) of transistors 210 and 220 being coupled together to node 205, the second main electrode (e.g., emitter) of transistor 210 coupled to reference line 101 and the second main electrode (e.g., emitter) of transistor 220 coupled to second reference line 102, the control electrodes (e.g., bases) of transistors 210 and 220 coupled to outputs 235 and 245, respectively, of op amp 230 and 240', respectively; and resistors 250 and 260 serially coupled between node 205 and reference line 102 via node 207, node 207 coupled to input 231 of op amp 230 and input 241 of op amp 240'.

Preferably, transistors 210 and 220 are of complementary types (e.g., pnp-type 210 and npn-type 220), input 231 of op amp 230 and input 241 of op amp 240' are non-inverting inputs ("+"), and input 232 of op amp 230 and input 242' of op amp 240' are inverting inputs ("−").

The apparatus receives a reference voltage at input terminal 203 and an input current $I_{IN}$ at the second main electrode (e.g., emitter) of transistor 210; in the event of a change of a voltage $V_{OUT}$ across resistors 250 and 260, (a) op amp 230 making transistor 210 non-conductive so that the flow of input current $I_{IN}$ to node 205 is substantially interrupted, and (b) op amp 240' making transistor 220 substantially conductive, so that capacities (e.g., capacitor 280) at node 205 with respect to reference line 102 are discharged.

The operation method of regulator 200 of system has been described in connection with FIGS. 1–2 and FIG. 4. In other words, a method of the present invention can be described as a method of supplying a load current $I_{OUT}$ to a load (e.g., to consuming device 120) while maintaining a load voltage $|V_{OUT}| \geqq |V_{OUT\ MIN}|$. The method comprises the following steps: (a) forwarding an input current $I_{IN}$ to current $I_{OUT}$ by transistor 210, thereby regulating the conduction of transistor 210 by operational amplifier 230 receiving an equivalent $|V_M|$ of load voltage $|V_{OUT}|$ and receiving a reference voltage $|V_{REF}|$; (b) monitoring the equivalent $|V_M|$ by operational amplifier 240 which also receives reference voltage $|V_{REF}|$ plus an offset voltage $|V_{OS}|$; (c) temporarily shorting the load voltage $|V_{OUT}|$ transistor 220 (conductive) controlled by operational amplifier 240 when equivalent $|V_M|$ exceeds $|V_{REF}|+|V_{OS}|$ the shorting being limited in time so that the load voltage stays $|V_{OUT}|>|V_{OUT\ MIN}|$. The conductance decreasing step is performed when the equivalent $|V_M|$ exceeds $|V_{REF}|$ of transistor 210. Preferably, the decreasing step is performed prior to the shorting step. In the monitoring step, a voltage divider (e.g., resistors 250 and 260) receives the load voltage $|V_{OUT}|$ and provides $|V_M|$.

Electronic system 100 with regulator 200, 500 of the present invention can be used in a variety of applications. In the mentioned example of a mobile phone, the regulator substantially consumes power from the battery only when the transmitter is active. A single regulator accommodates the different and sometimes conflicting power requirements of the transmitter and the memory. The transmitter can operate at a high burst rate. Also, the absence of mandatory waiting time (e.g., between $t_1$ and $t_2$) can simplify the transmitter control software. Additional components (e.g., op amp 240 and transistor 220) needed to implement the regulator of the present invention can be integrated together with the other components (e.g., op amp 230 and transistor 210) in or on a single semiconductor substrate. This features are of great practical significance.

While the invention has been described in terms of particular structures, devices and methods, those of skill in the art will understand based on the description herein that it is not limited merely to such examples and that the full scope of the invention is properly determined by the claims that follow.

I claim:

1. A system comprising:

a regulating element for temporarily pulling an output node to a power line;

a switch for temporarily pulling said output node to a reference line;

a first comparator for controlling said regulating element, said first comparator receiving a measurement voltage derived from said output node; and a second comparator for controlling said switch, said second comparator receiving said measurement voltage, said second comparator having an input offset relative to said first comparator so that said second comparator activates said switch to pull said output node to said reference line after said first comparator has de-activated said regulating element to disconnect said output node from said power line.

2. The system of claim 1 wherein said first and second comparators derive said measurement voltage via a voltage sensor with first and second resistors serially coupled between said output node and said reference line.

3. The system of claim 1 wherein said first and second comparators have input transistors with common first main electrodes and wherein second main electrodes of said input transistors are coupled to different potentials.

4. An apparatus, comprising:

first and second transistors serially coupled between first and second reference lines via an output node, said first transistor temporarily forwarding d.c. input current from said first reference line to said output node and said second transistor temporarily discharging capacitance between said output node and said second reference line;

a consuming device coupled between said output node and said second reference line, said consuming device temporarily sinking a load current;

a voltage sensor measuring a voltage between said output node and said second reference line and providing a measurement voltage; and first and second comparators for controlling said first and second transistors, respectively, said first and second comparators each receiving said measurement voltage, and said second comparator having an offset relative to said first comparator, wherein changes of said measurement voltage when said consuming device stops to sink said load current causes consecutively (a) said first transistor to become non-conductive and (b) said second transistor to become conductive so that said first transistor releases said output node before said second transistor pulls said output node to said second reference line.

5. The apparatus of claim 4 wherein said second transistor pulls said output node to said second reference line only after said first transistor has released said output node from said first reference line.

6. A method of supplying a load current ($I_{OUT}$) to a load while maintaining a load voltage whose amount is larger than or equal to a minimum output voltage ($|V_{OUT}| \geqq |V_{OUT\ MIN}|$), said method comprising the steps of:

(a) forwarding an input current ($I_{IN}$) to said load current ($I_{OUT}$) by a first transistor, thereby regulating the conduction of said first transistor by a first operational amplifier receiving a portion ($|V_M|$) of said load voltage ($|V_{OUT}|$);

(b) monitoring said portion ($|V_M|$) by a second operational amplifier which has an offset voltage ($|V_{OS}|$); and (c) temporarily shorting said load voltage ($|V_{OUT}|$) by a second transistor controlled by said second operational amplifier when said portion ($|V_M|$) exceeds said offset voltage ($|V_{OS}|$), said shorting being limited in time so that the load voltage satisfies the condition to be larger than or equal to said minimum output voltage ($|V_{OUT}| \geqq |V_{OUT\ MIN}|$).

7. The method of claim 6 further comprising providing a reference voltage ($|V_{REF}|$) to said first and second operational amplifiers and decreasing the conductance of said first transistor when said portion ($|V_M|$) differs from said reference voltage ($|V_{REF}|$) in a predetermined way.

8. The method of claim 7 wherein said decreasing step is performed prior to said shorting step.

9. The method of claim 6 wherein in said monitoring step, a voltage divider receives said load voltage ($|V_{OUT}|$) and provides said portion ($|V_M|$).

* * * * *